US007591114B2

(12) United States Patent
Herron, III

(10) Patent No.: US 7,591,114 B2
(45) **Date of Patent: *Sep. 22, 2009**

(54) HIGH STRENGTH LOW DENSITY MULTI-PURPOSE PANEL

(75) Inventor: Warren L. Herron, III, Gulf Breeze, FL (US)

(73) Assignee: Herron Intellectual Property Holdings, LLC, Gulf Breeze, FL (US)

( * ) Notice: Subject to any disclaimer, the term of this patent is extended or adjusted under 35 U.S.C. 154(b) by 555 days.

This patent is subject to a terminal disclaimer.

(21) Appl. No.: 11/370,072

(22) Filed: Mar. 7, 2006

(65) Prior Publication Data

US 2007/0119120 A1 May 31, 2007

Related U.S. Application Data

(63) Continuation-in-part of application No. 10/796,732, filed on Mar. 8, 2004, now Pat. No. 7,021,017.

(51) Int. Cl.

| | |
|---|---|
| ***B27K 1/00*** | (2006.01) |
| ***B27K 3/00*** | (2006.01) |
| ***B27K 5/00*** | (2006.01) |
| ***E04B 1/62*** | (2006.01) |

(52) U.S. Cl. ..... 52/516; 52/630; 52/660; 428/116; 428/131

(58) Field of Classification Search ..... 52/516, 52/316, 660, 630; 428/116, 117, 131, 166, 428/178, 44, 57, 58

See application file for complete search history.

(56) References Cited

U.S. PATENT DOCUMENTS 3,038,278 A 6/1962 Hauer
3,108,924 A 10/1963 Adie
3,527,664 A 9/1970 Hale
3,597,891 A 8/1971 Martin
3,689,345 A 9/1972 Figge et al.
3,914,486 A 10/1975 Borford
3,919,380 A 11/1975 Smarook et al.
4,020,205 A 4/1977 Haselbauer
4,088,723 A 5/1978 Norton
4,134,243 A 1/1979 Fries
4,203,268 A 5/1980 Gladden, Jr. et al.
4,261,433 A 4/1981 Probst
4,348,442 A 9/1982 Figge
4,356,880 A 11/1982 Downs (Continued)

*Primary Examiner*—Richard E Chilcot, Jr.
*Assistant Examiner*—Chi Q Nguyen
(74) *Attorney, Agent, or Firm*—Roy, Kiesel, Keegan & DeNicola

(57) ABSTRACT

A high strength low density multi-purpose panel. The preferred panel is made of a plurality of sections, organized into rows and columns, and each preferably including two voids. The voids are preferably triangular in cross-section and may be rounded at their apex and corners. Solid strips of material, extending between opposite corners and between the faces of each section, intersect at the center of each face, resulting in an X-shaped cross in each section. Each section is rotated ninety degrees with respect to each adjacent section. Each section shares sides with four adjacent sections and corners with four cater-corned sections. The common sides create perpendicular sets of parallel braces running the panel's length and width. The shared corners align and join the X-shaped cross braces with the X-shaped cross braces of their cater-cornered neighbors, creating diagonal braces that run across the entire panel.

23 Claims, 14 Drawing Sheets

U.S. PATENT DOCUMENTS

| | | | | |
|---|---|---|---|---|
| 4,495,237 | A | 1/1985 | Patterson | |
| 4,539,245 | A | 9/1985 | Sarin | |
| 4,612,225 | A | 9/1986 | Graffam et al. | |
| 4,889,758 | A | 12/1989 | Rinkewich | |
| 4,910,060 | A | 3/1990 | Nakanishi | |
| 5,030,501 | A | 7/1991 | Colvin et al. | |
| 5,180,619 | A | 1/1993 | Landi et al. | |
| 5,247,749 | A | 9/1993 | Bury | |
| 5,256,007 | A | 10/1993 | Allen | |
| 5,470,641 | A | 11/1995 | Shuert | |
| 5,487,930 | A | 1/1996 | Lockshaw et al. | |
| 5,579,722 | A | 12/1996 | Yamamoto et al. | |
| 5,599,606 | A | 2/1997 | Disselbeck et al. | |
| 5,797,230 | A * | 8/1998 | Lassen | 52/323 |
| 6,187,401 | B1 | 2/2001 | Heisel et al. | |
| 6,199,334 | B1 | 3/2001 | Malloy | |
| 6,200,664 | B1 | 3/2001 | Figge et al. | |
| 7,021,017 | B2 * | 4/2006 | Herron | 52/516 |
| 2002/0028318 | A1 | 3/2002 | Clark | |
| 2003/0039792 | A1 | 2/2003 | Hable et al. | |
| 2004/0096624 | A1 | 5/2004 | Albright | |

* cited by examiner

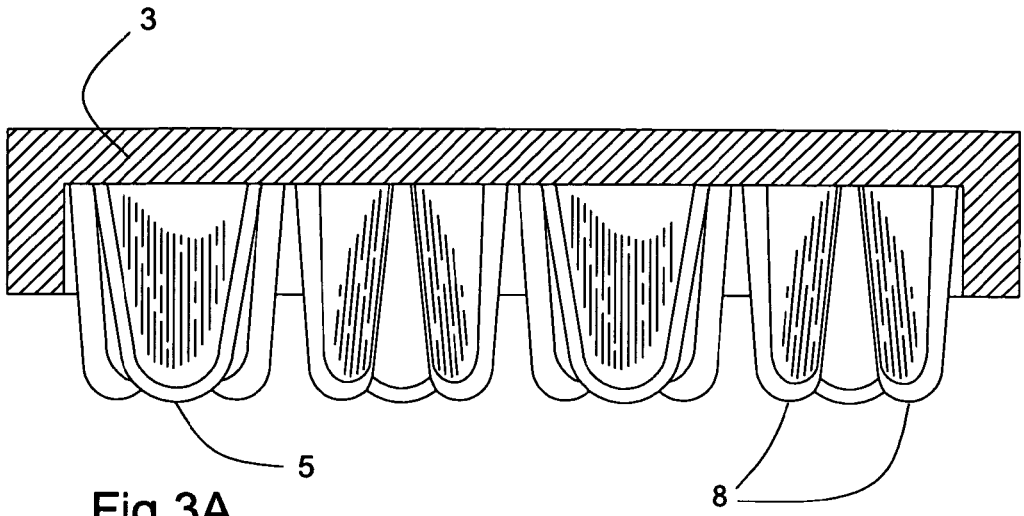
Fig 3A
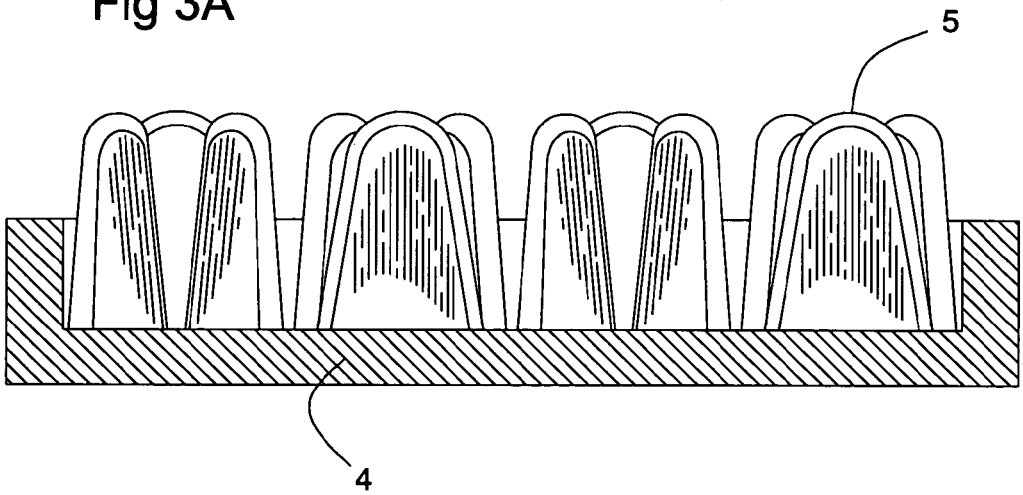
Fig 3B
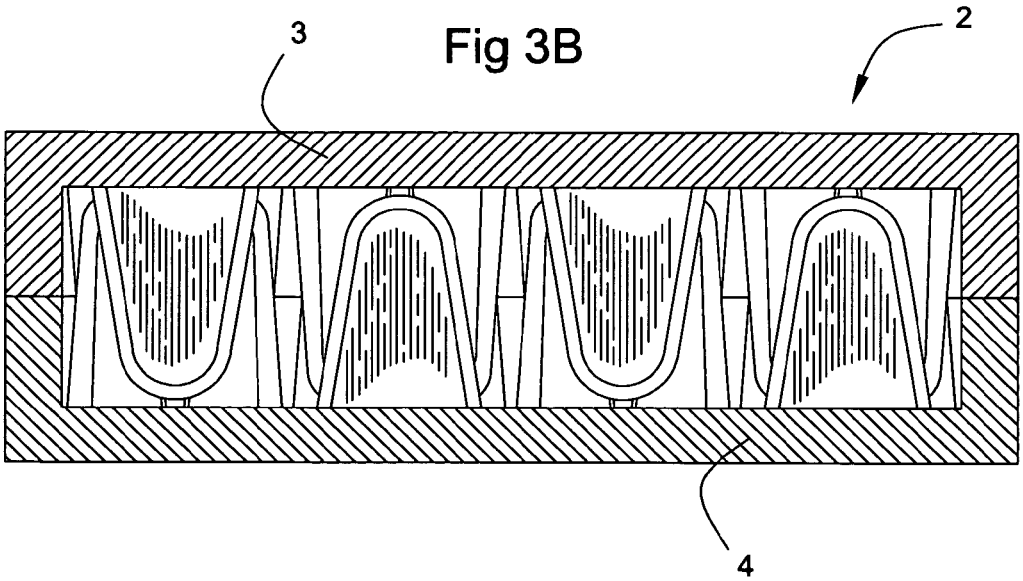

Fig 6
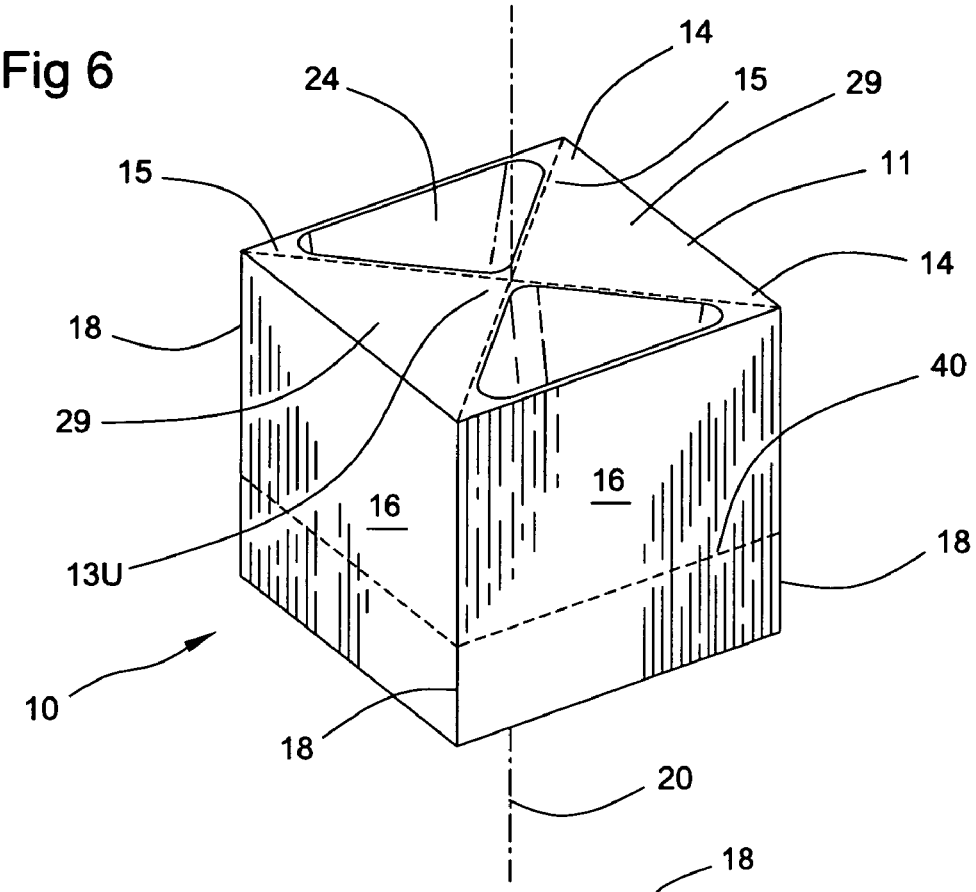
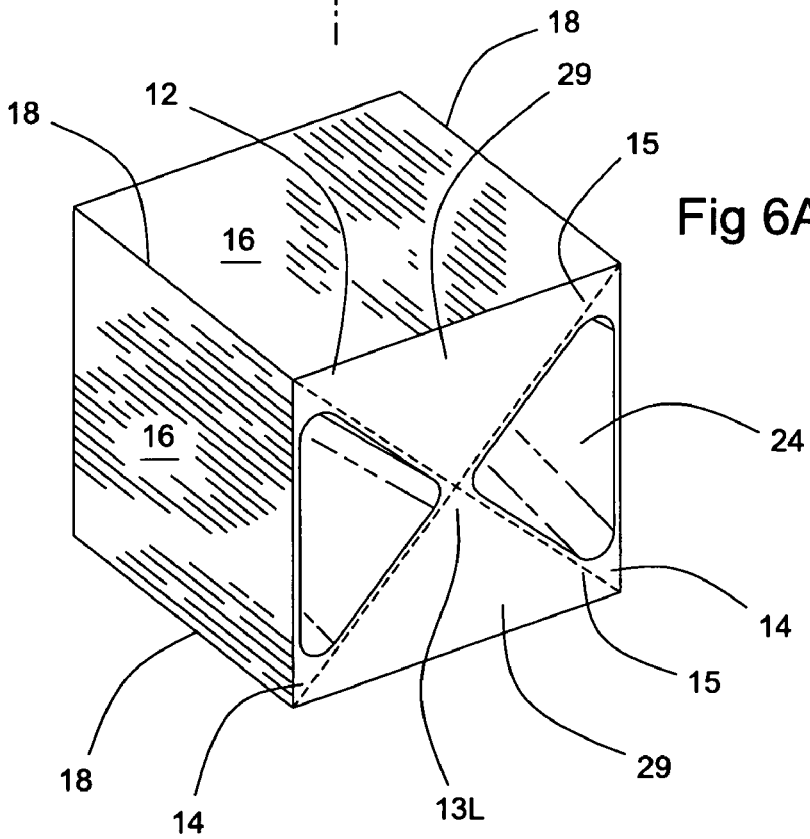
Fig 6A 113U
111
106
107
220
110
114
115
129A
129
113U
111
129A
114
129A
106
115
114
129

HIGH STRENGTH LOW DENSITY MULTI-PURPOSE PANEL

PRIORITY CLAIM

This application is a continuation-in-part of allowed U.S. application Ser. No. 10/796,732 filed Mar. 8, 2004, now U.S. Pat. No. 7,021,017, which is hereby incorporated by reference in its entirety.

BACKGROUND OF THE INVENTION

1. Field of the Invention

The invention relates to structural panels in general and to high strength low density panels in particular.

2. Prior Art

Construction panels that include void spaces in order to save on material and/or weight are well known in the prior art. However, many of these panels are deficient in at least one of several areas. The void spaces in many prior art panels are poorly designed. The internal shape of the void spaces are seldom configured to enhance the strength of the structure. Furthermore, the positioning of most prior art void spaces within the panel are not selected to facilitate reinforcement of the other void spaces. To the extent that the prior art panels have reinforcing members at all, the reinforcing members seldom extend across the entire panels in every direction. Thus, loads applied to an area of the prior art panels often must be borne by that area in isolation rather than distributing the load across the entire panel. Because of these design deficiencies, greater amounts of material are typically required to achieve the desired panel strength in the prior art. As a result, the prior art panels frequently either are not as economical as possible in terms of cost and weight or their desired strength is sacrificed to achieve weight and/or economic goals. Accordingly, a multipurpose panel meeting the following objectives is desired.

OBJECTS OF THE INVENTION

It is an object of the invention to provide a construction panel that is relatively high in strength.

It is another object of the invention to provide a construction panel that is relatively low in density.

It is another object of the invention to provide a construction panel that is relatively economical in terms of material used.

It is still another object of the invention to provide a construction panel having reinforcing braces extending the length and width of the panel.

It is yet another object of the invention to provide a construction panel having reinforcing braces extending diagonally across the panel.

It is still another object of the invention to provide a construction panel having reinforcing members extending the depth of the panel.

It is yet another object of the invention to provide a construction panel whose void spaces are arched to maximize their weight bearing ability.

It is still another object of the invention to provide a construction panel that may be easily curved to conform to a desired shape.

SUMMARY OF THE INVENTION

The invention comprises a high strength low density panel. The panel comprises a plurality of boxes each of which preferably include four void spaces. The void spaces are rounded at their apex and three sided. The corners of the void spaces are preferably rounded. The void spaces are preferably alternately inverted with respect to each other in a radial fashion: up-down-up-down. The perimeter of each box is preferably made of four solid side panels, extending from the upper face to the lower face all the way around each box. Cross panels also extend from each corner of each box to the opposite corner. Like the side panels, the cross panels also extend from the upper to the lower face of each box. The cross panels meet and intersect at the center of each box, resulting in a generally X-shaped cross running from corner to corner in each box. A solid triangular panel is preferably positioned on the upper and lower face of each box, above each apex of each void space. The triangular panels meet in the middle of each face to create a generally hourglass shape. However, the triangular panels in the upper and lower faces are preferably rotated approximately ninety degrees with respect to each other.

The boxes are organized in rows and columns. Each box is rotated approximately ninety degrees with respect to each adjacent box in its column and its row. This will result in each box sharing one side with each of the four adjacent boxes and sharing a corner with each of the four cater-corned boxes. By sharing sides with the row and column adjacent boxes, the common sides will create perpendicular sets of parallel braces that run across the length and width of the panel, repeatedly intersecting with one another. By sharing a corner with the adjacent cater-cornered boxes, the X-shaped cross panels of each box will align and join with the X-shaped cross panels of their cater-cornered neighbors, resulting in a set of diagonal braces that runs across the entire panel and which intersects and reinforces the other braces at the corner of each box, to provide a construction panel that is high in strength but low in density and weight.

BRIEF DESCRIPTION OF THE FIGURES

FIG. 3A is a cut-away side view of an open mold for forming a preferred embodiment of the high strength low density panel according to the present invention.

FIG. 3B is a cut-away side view of a closed mold for forming a preferred embodiment of the high strength low density panel according to the present invention.

FIG. 6 is a perspective view of a box component of a preferred embodiment of a high strength low density panel according to the present invention.

FIG. 6A is a perspective view of the box component of FIG. 6 rotated ninety degrees such that upper surface 11 is turned away from the viewer.

DETAILED DESCRIPTION OF THE PREFERRED EMBODIMENTS

Figure 1:
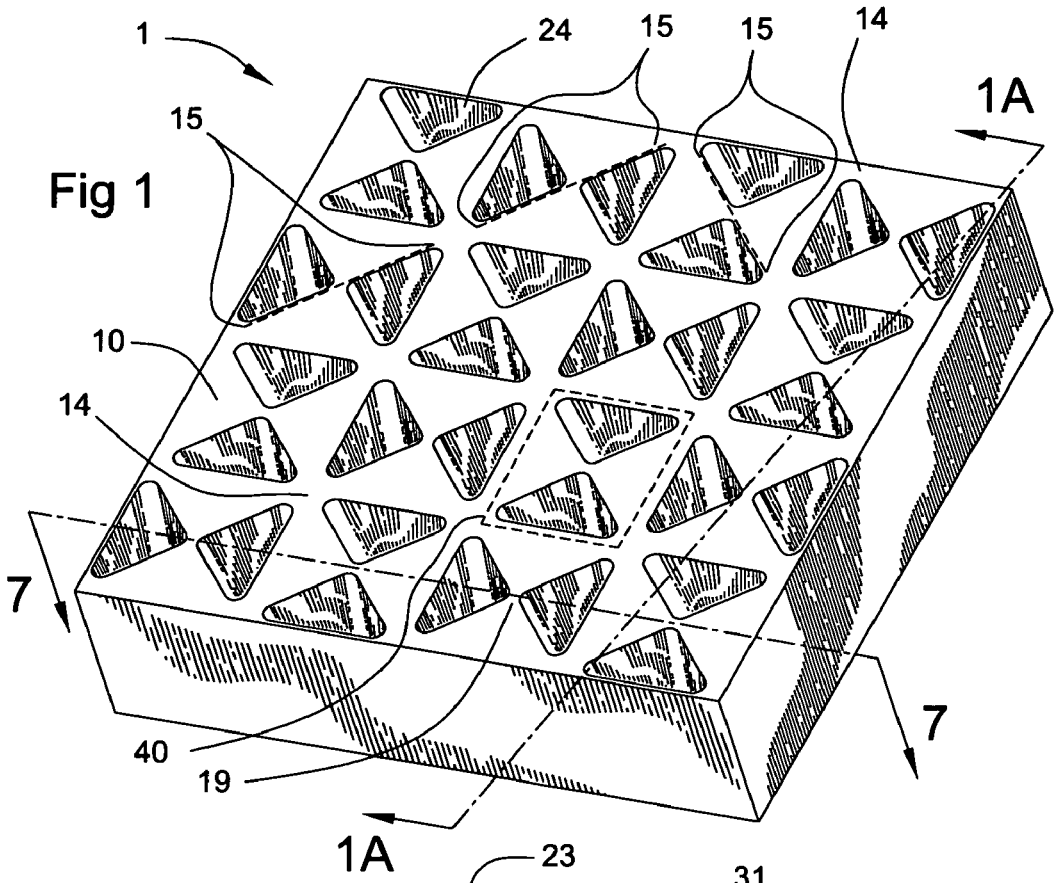
FIG. 1 is perspective view of a preferred embodiment of a high strength low density panel according to the present invention
Figure 1A:
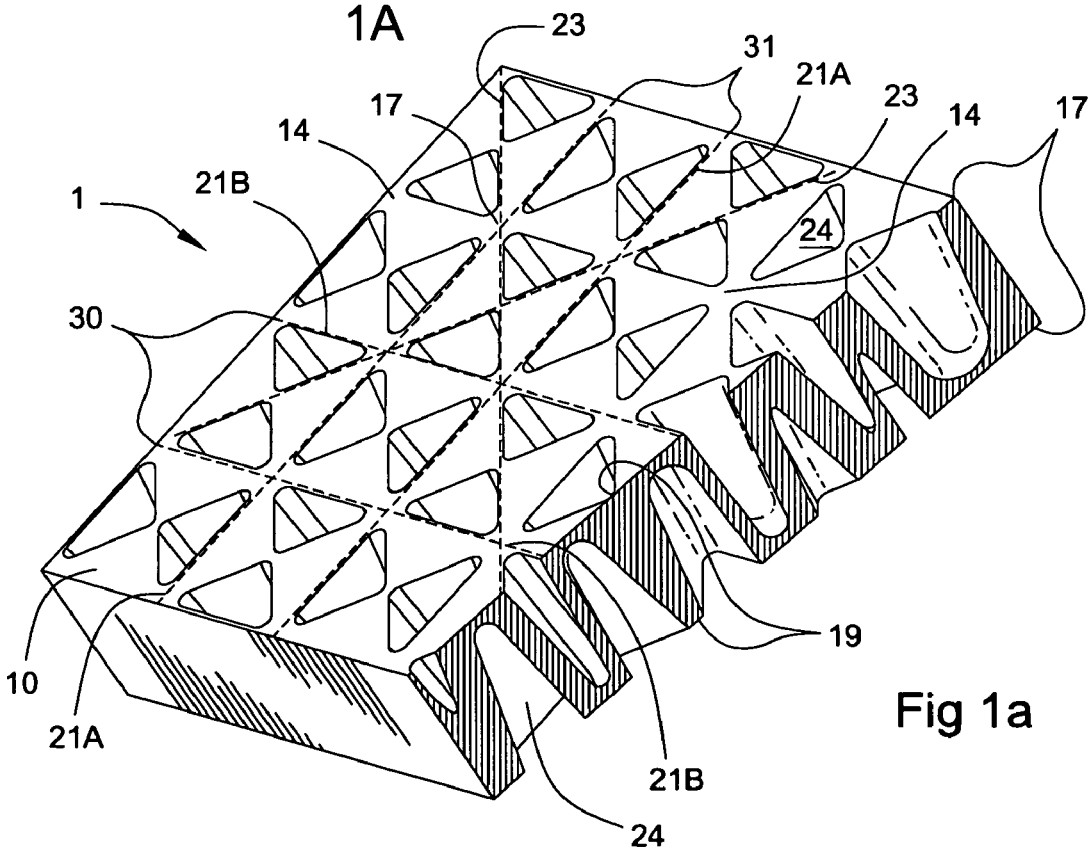
FIG. 1A is a perspective cut-away view of the preferred embodiment of the high strength low density panel of FIG. 1 cut along line 1A and with the preferred position of some of the braces illustrated in dashed lines.
Figure 2:
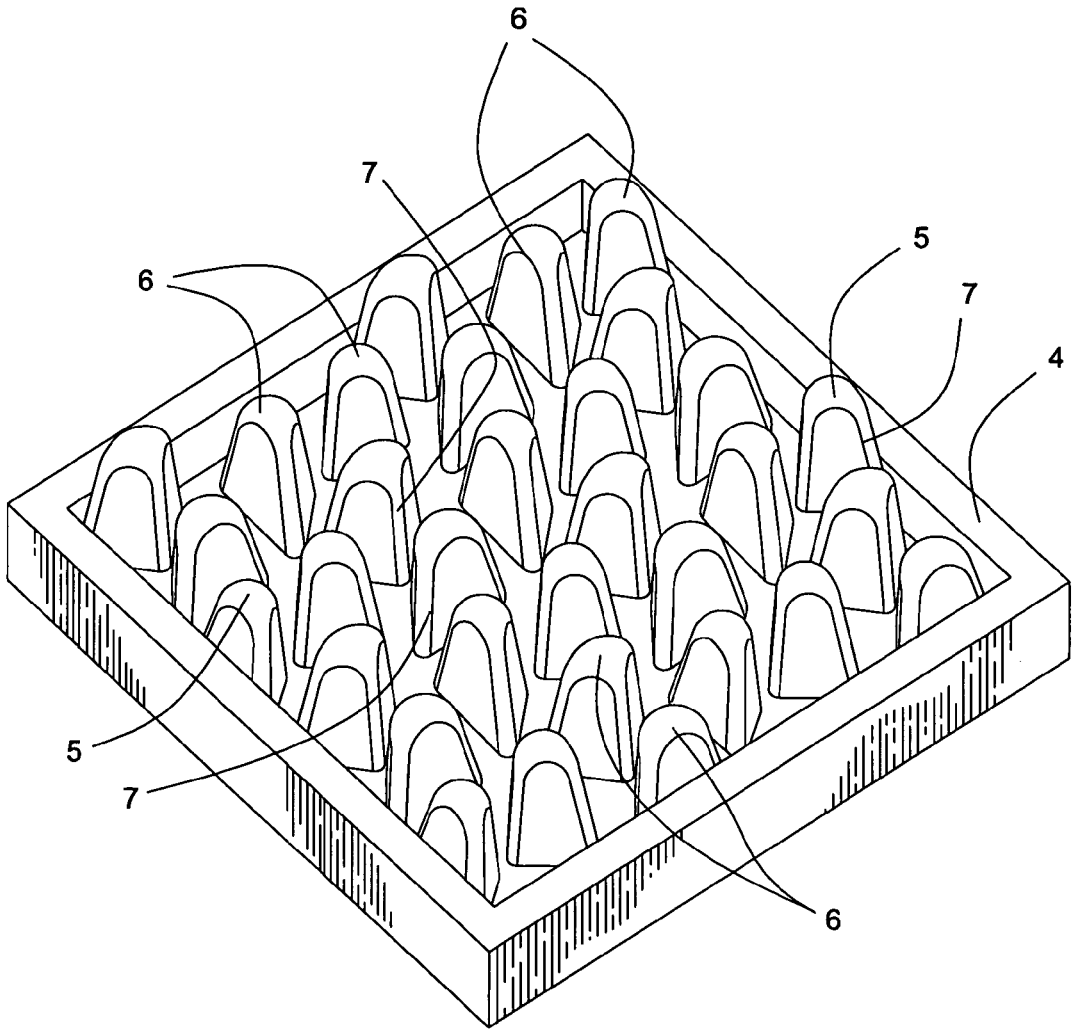
FIG. 2 is a perspective view of one half of a mold for forming a preferred embodiment of the high strength low density panel according to the present invention.
Figure 4:
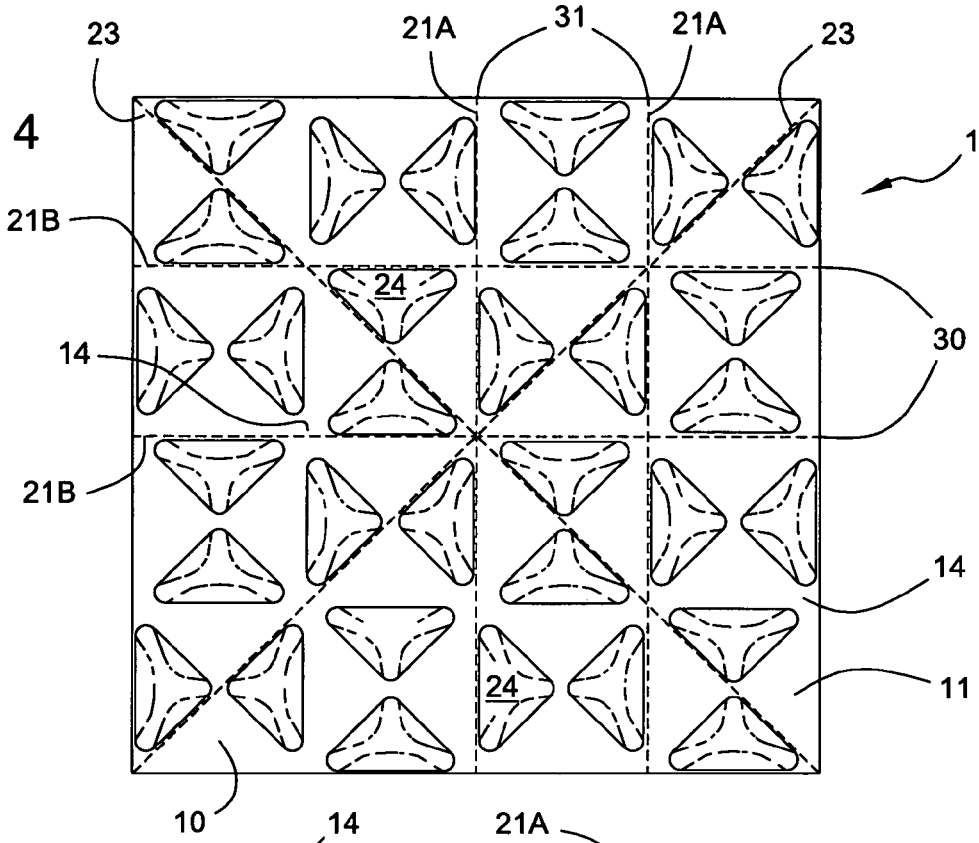
FIG. 4 is a top plan view of a preferred embodiment of a high strength low density panel according to the present invention with the preferred position of some of the bracing shown in dashed lines.
Figure 5:
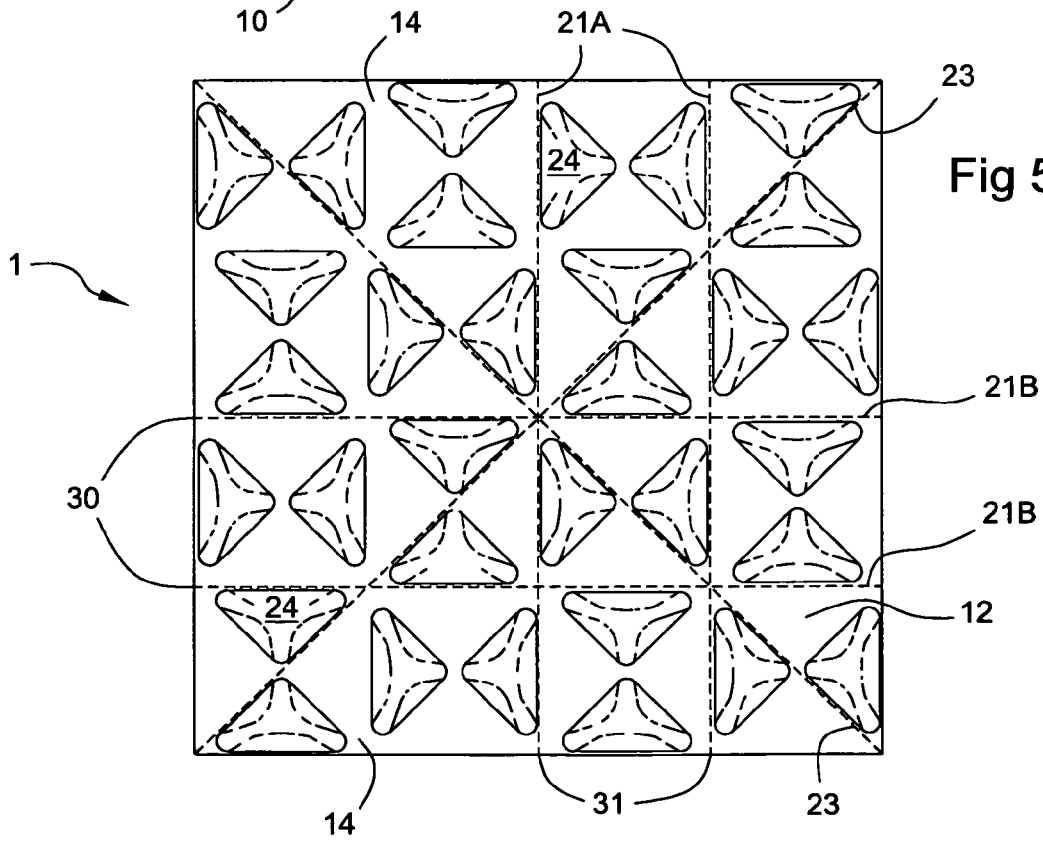
FIG. 5 is a plan mirror image of the bottom of the high strength low density panel shown in FIG. 4.
Figure 6B:
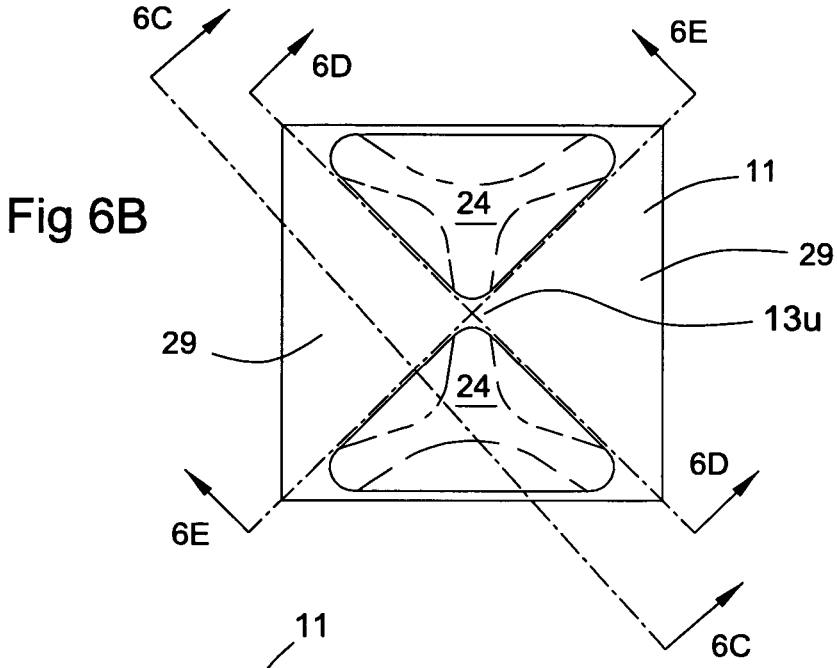
FIG. 6B is a top plan view of a box component of a preferred embodiment of a high strength low density panel according to the present invention.
Figure 6C:
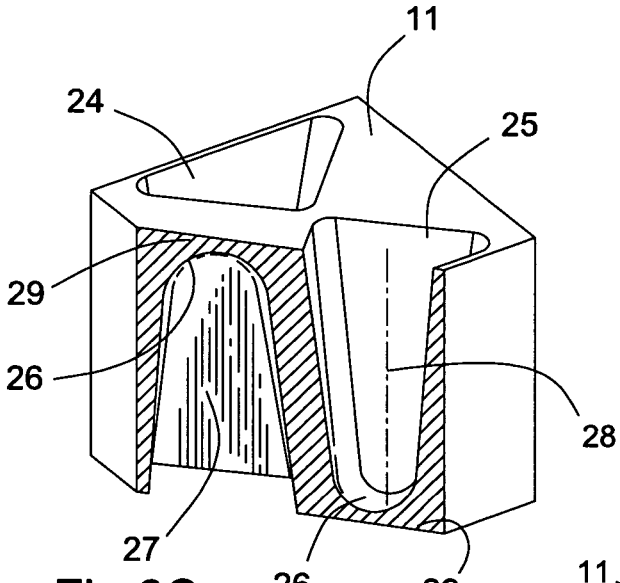
FIG. 6C is a perspective cut-away view of the box component of FIG. 6B cut along line 6C.
Figure 6D:
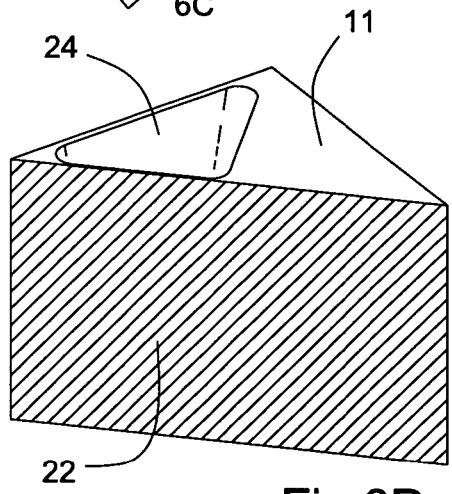
FIG. 6D is a perspective cut-away view of the box component of FIG. 6B cut along line 6D.
Figure 6E:
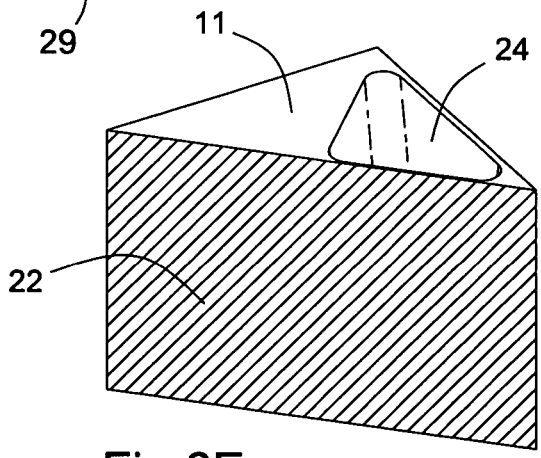
FIG. 6E is a perspective cut-away view of the box component of FIG. 6B cut along line 6E.
Figure 7:
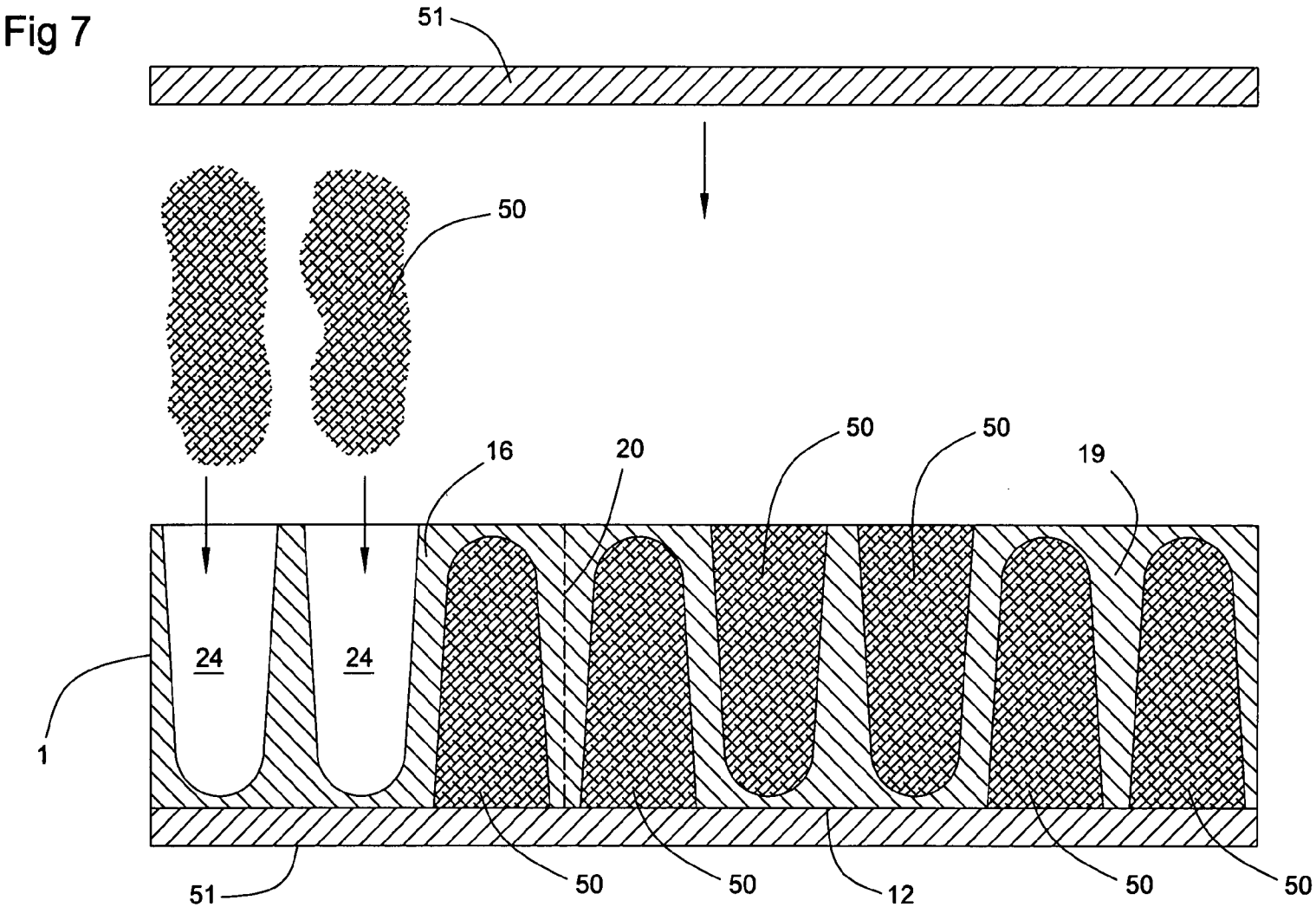
FIG. 7 is a side cut-away and partially exploded view of the preferred embodiment of the high strength low density panel shown in FIG. 1, cut along line 7 and having laminated faces and flame retardant sound proofing material in its void spaces.
Figure 8:
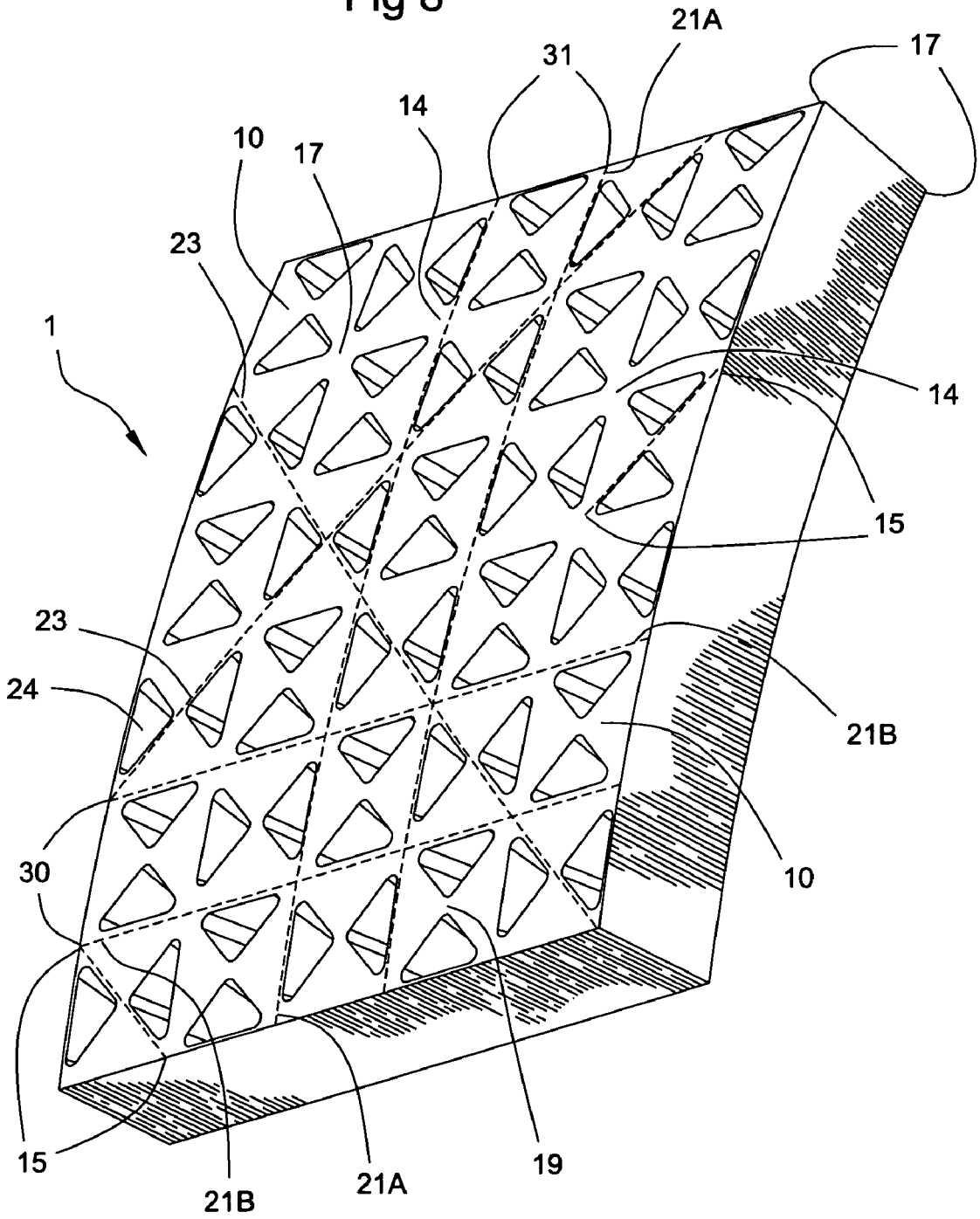
FIG. 8 is a perspective view of a preferred embodiment of a high strength low density panel wherein the panel is curved.
Figure 9A:
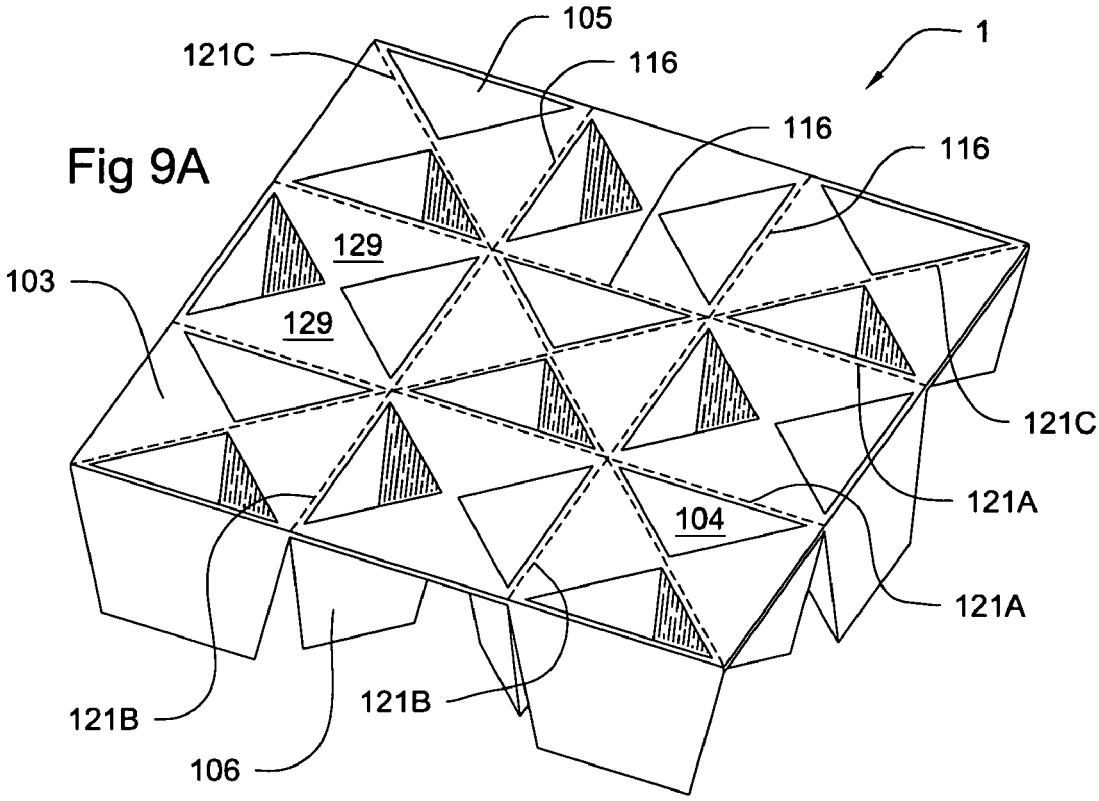
FIG. 9A is top perspective view of another preferred embodiment of a high strength low density panel wherein the panel is particularly suited for use in curved applications.
Figure 9B:
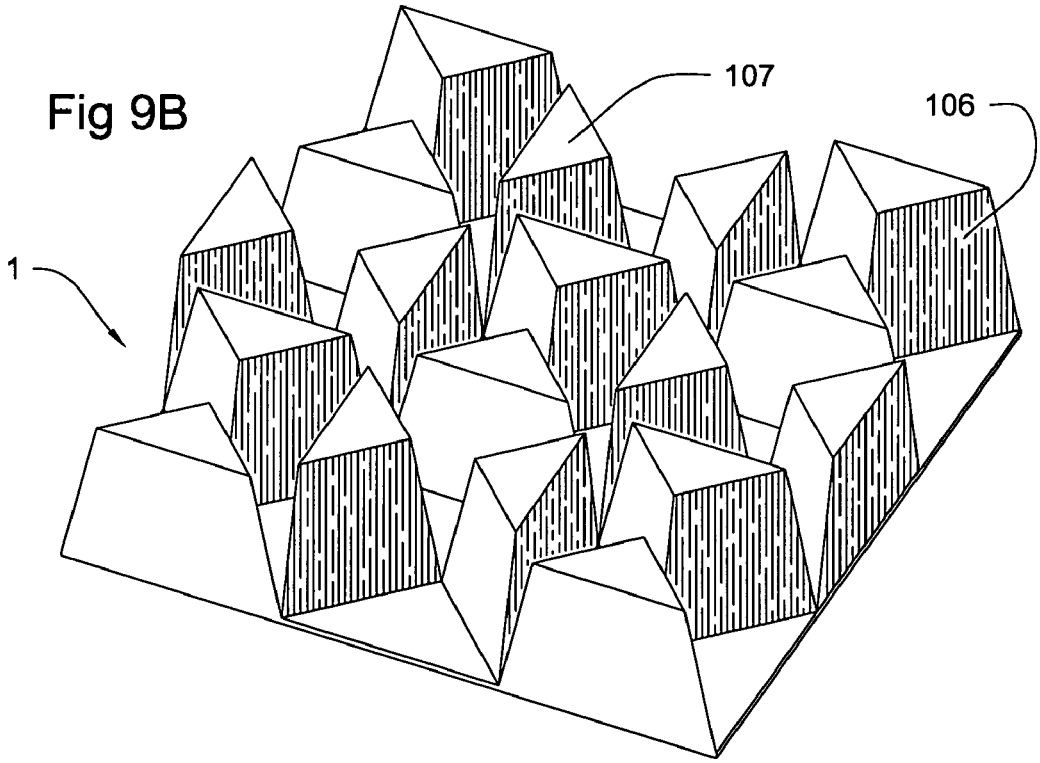
FIG. 9B is a bottom perspective view of the panel shown in FIG. 9A.
Figure 10A:
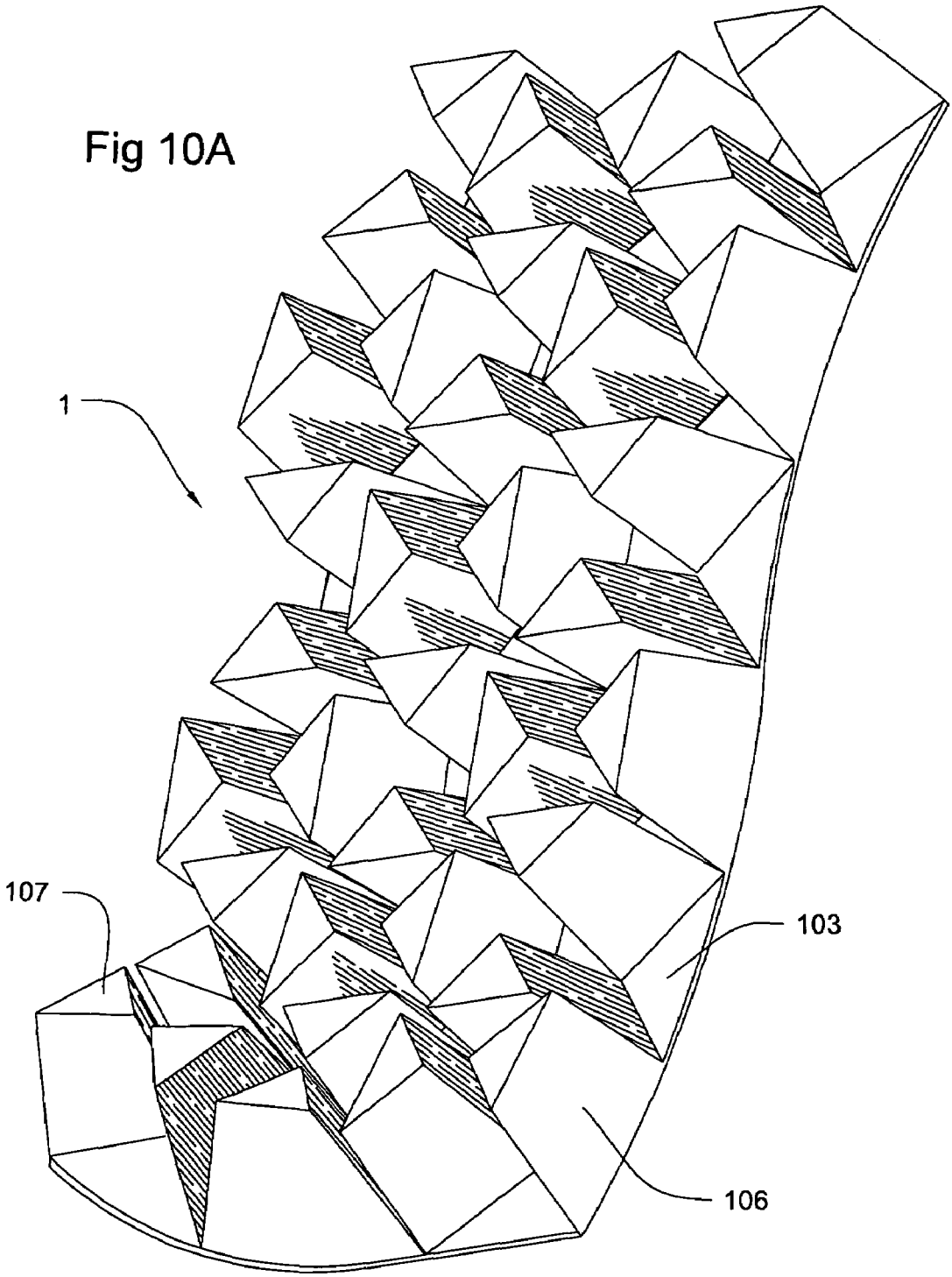
FIG. 10A is a bottom perspective view of the embodiment of FIG. 9A wherein the panel is shown curved.
Figure 10B:
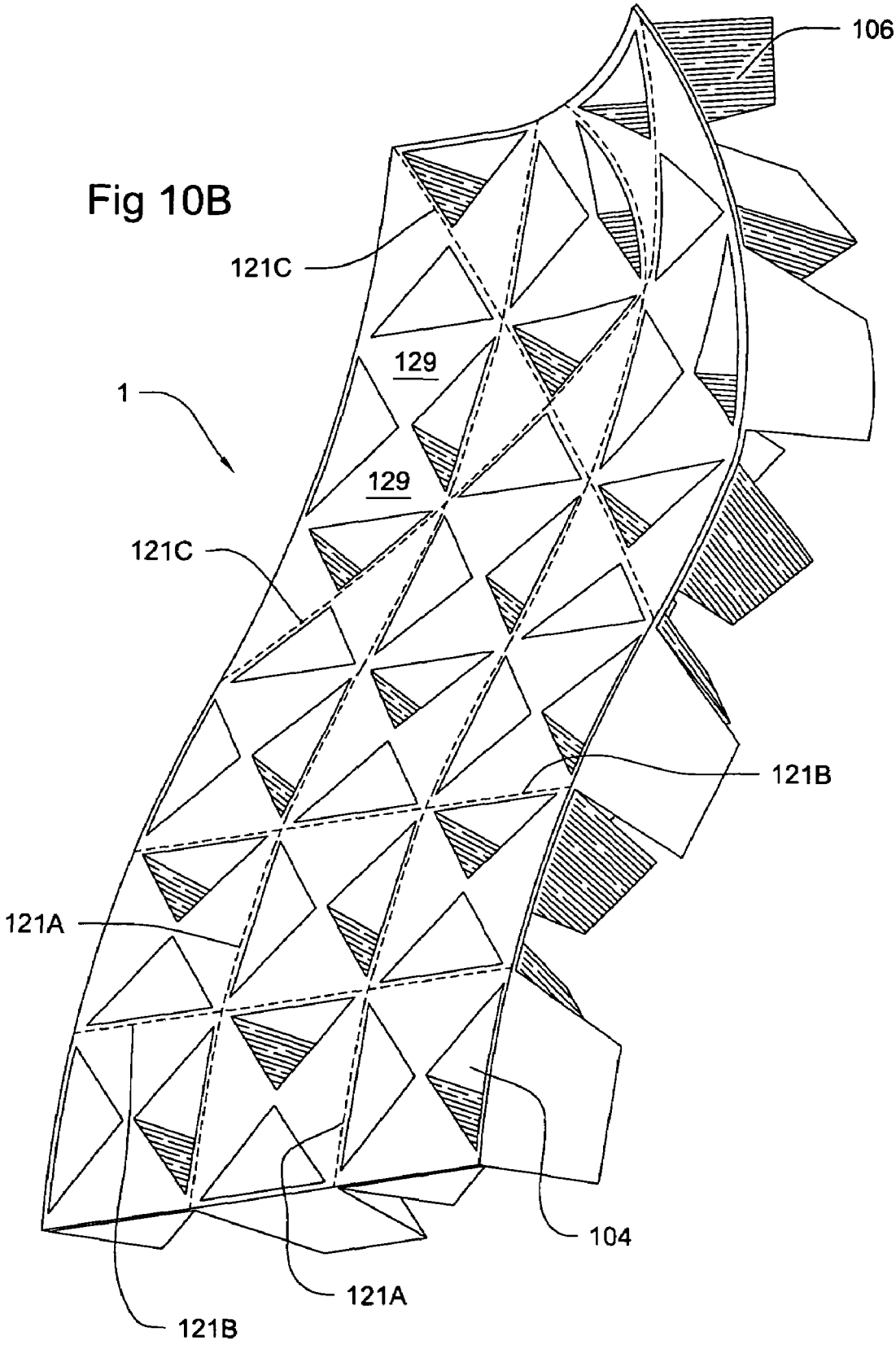
FIG. 10B is a top perspective view of the panel shown in FIG. 10A.
Figure 11:
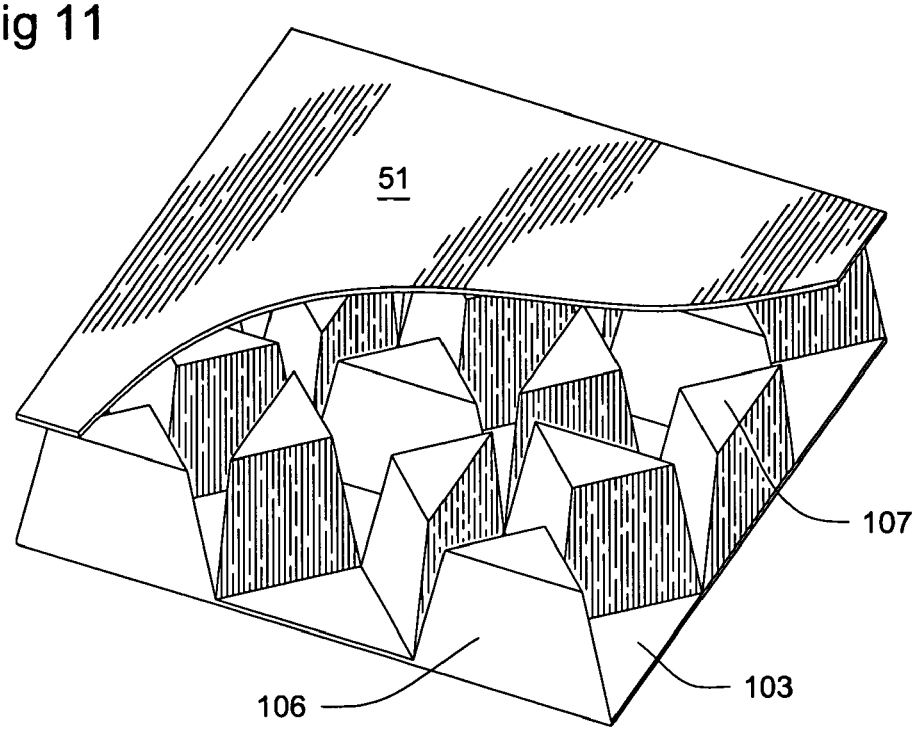
FIG. 11 is a bottom perspective view of the panel of FIG. 9B with a laminated surface shown in partial cut-away.
Figure 12:
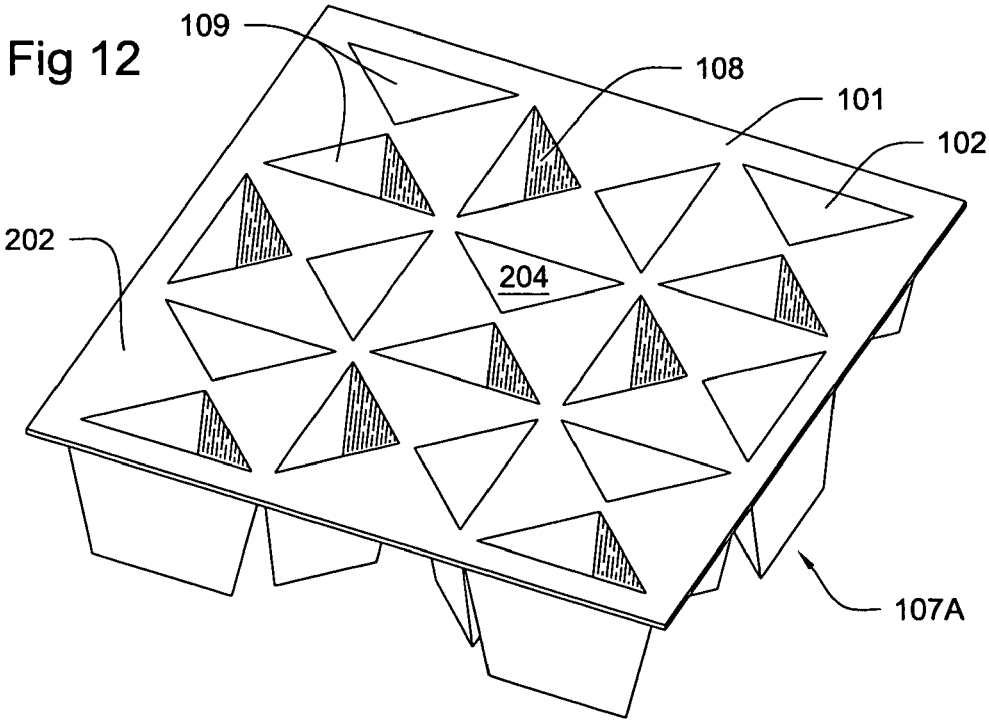
FIG. 12 is a top perspective view of a vacuum mold which can be used to form the panel of FIG. 9A.
Figure 13:
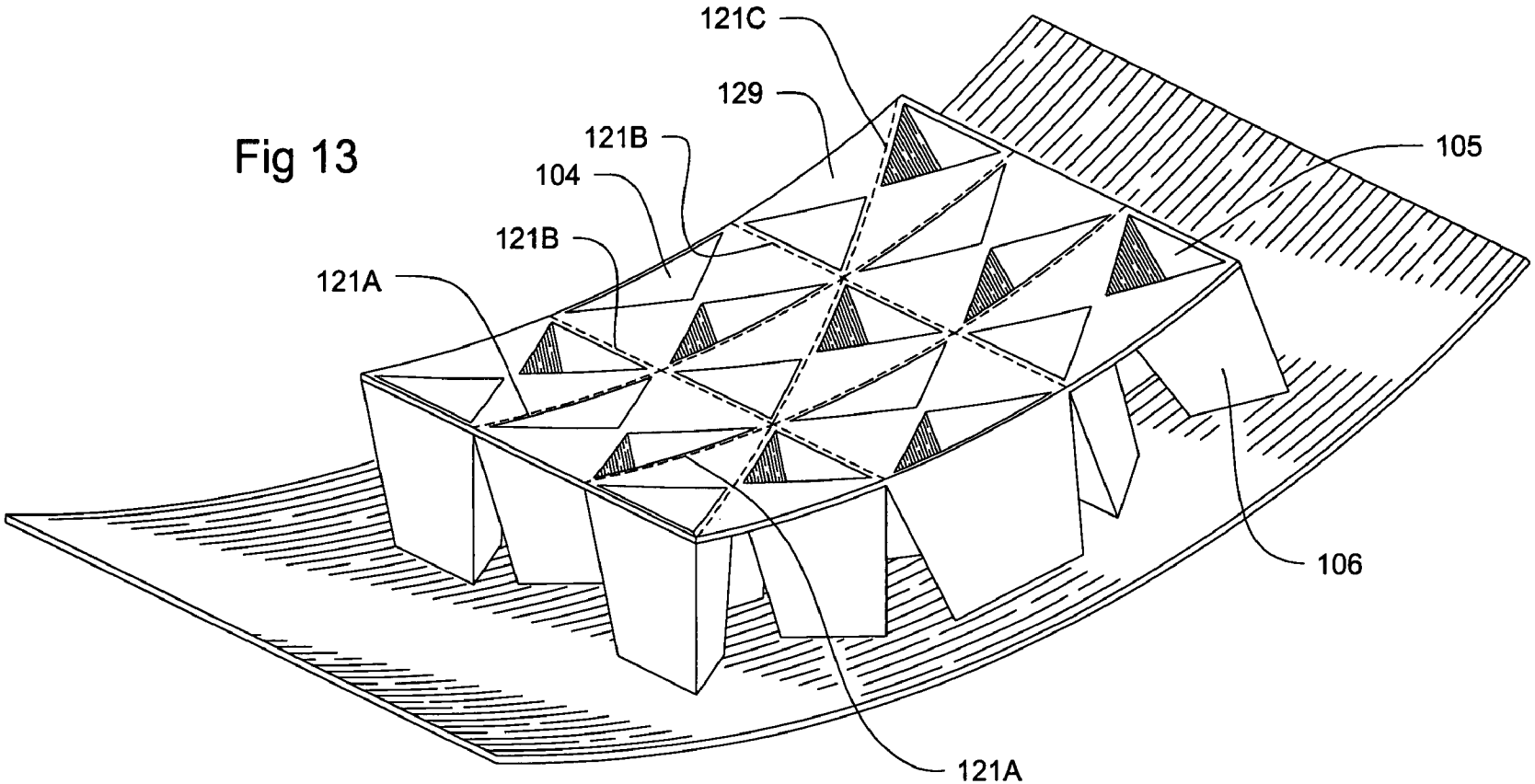
FIG. 13 is top perspective view of the embodiment of FIG. 9A shown attached to a curved surface.
Figures 14, 15:
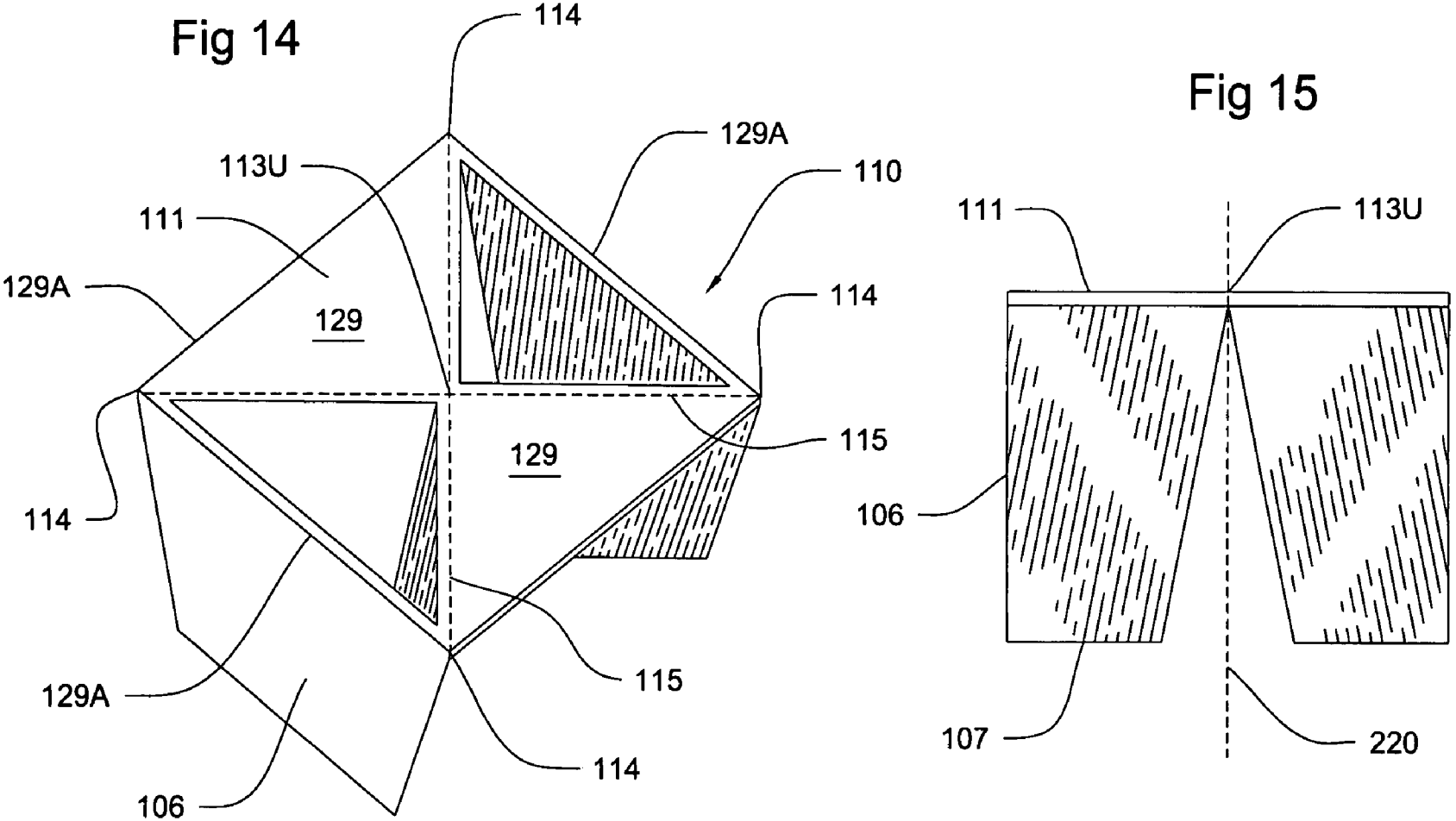
FIG. 14 is a top perspective view of a section of which the embodiment of FIG. 9A is composed.
FIG. 15 is a side view of the section of FIG. 14.

The invention comprises a high strength low density structural panel 1. Panel 1 may be flat or curved as desired. In the preferred embodiment, panel 1 is formed from a mold 2. Mold 2 comprises a first plate 3 and a second plate 4. A plurality of inserts 5 will be positioned on plates 3, 4. Inserts 5 will preferably have a three sided conical or pyramidal shape, such that they will be generally triangular in cross section. Each side of inserts 5, except the base, will preferably angle in toward one another. Each insert 5 will have three corners 7. In the preferred embodiment, corners 7 will be rounded. The ends of inserts 5 distal from the plate 3 or 4 on which insert 5 is mounted will also be rounded.

Inserts 5 will preferably be arranged on plates 3 and 4 in corresponding pairs and sets of pairs. Each pair of inserts 6 will comprise two inserts 5. The inserts 5 of each pair 6 will preferably be positioned so that one of the corners 7 on one insert 5 faces one of the corners 7 on the other insert 5 in the pair. An opposing pair 8 of inserts 5 will be mounted on the opposite plate 3, 4 from the first insert pair 6. The opposing pair 8 will be rotated approximately ninety degrees from the first pair 6. When plates 3, 4 of mold 2 come together, the inserts S of each set of pairs 6, 8 will come together in an up-down-up-down radial pattern. The pairs 6, 8 will be organized on plates 3, 4 in rows and columns. Each pair 6, 8 will preferably be rotated about ninety degrees with respect to each adjacent pair 6, 8 in both the rows and the columns. As a result, each set of pairs 6, 8 will also be rotated approximately ninety degrees with respect to each adjacent set of pairs 6, 8. The length and circumference of the inserts 5 may vary as desired.

During the preferred manufacturing process, mold 2 will be closed, bringing plates 3, 4 together to the desired closeness. Mold 2 will then be filled with plastic, rubber, foam, cement, steel, aluminum, or any other moldable material. Once the material has hardened and/or cured, mold 2 will open leaving the desired high strength low density panel 1.

High strength low density panel 1 is comprised of a plurality of box shaped sections 10. It will be appreciated by those skilled in the art that in the preferred embodiment boxes 10 will not be physically distinct from one another. Rather, each box 10 will preferably be joined seamlessly with its neighbors so that an integral panel 1 is provided. Thus, the side panels 16 (discussed below) of each box 10 will preferably be shared with adjacent boxes 10 as will corners 14 and corner edges 18 (also discussed below). However, for purposes of discussing panel 1, it is convenient to consider the sections corresponding to each group of inserts 5 as boxes 10.

Each box section 10 has an upper face 11 and a lower face 12. Upper face 11 and lower face 12 each have a midpoint 13U and 13L. Upper face 11 and lower face 12 are preferably generally rectangular and most preferably generally square in shape. Preferably, upper face 11 and lower face 12 will each have four corners 14 and be about the same size and shape.

By positioning inserts 5 as described above in mold 2, a continuous band of material 15 will extend from each corner 14 through midpoint 13U or 13L to the opposite corner 14. These continuous bands of material 15 will thus extend generally diagonally across each face 11, 12 of each box section 10, in a generally X-shaped pattern. Continuous bands of material 15 will strengthen each box 10. Moreover, boxes 10 are positioned in panel 1 so that the corners 14 of one box 10 are adjacent to the corners 14 of three adjacent boxes 10. At each corner intersection, each box 10 will share a side panel 16 with two radially adjacent boxes 10 but will touch the other adjacent, but non-radially adjacent, box 10 only at a corner 14—i.e., the cater-corner box 10. Continuous bands of material 15 in one box 10 will join with continuous bands of material 15 in the non-radially adjacent (cater-corner) box 10. This will result in continuous bands of material 15 running diagonally across the upper and lower faces of the entire panel 1, rather than simply across each individual box 10. Thus, continuous bands of material 15 will provide reinforcement to the entire panel 1.

By making the external circumference of each set of insert pairs 6, 8 at least slightly smaller than the perimeter of each corresponding box 10, a continuous column of material 17 will be provided at each corner edge 18—that is that portion of each box 10 extending from one corner 14 of upper face 11 to the corresponding corner 14 of lower face 12. The continuous columns 17 will provide compression strength to panel 1 in the dimension perpendicular to upper and lower faces 11, 12. It will be understood that by "column" the inventor does not mean to imply that a smooth rod of material having a circular cross section will or must be found. To the contrary, the inventor means to encompass continuous sections of solid material of indeterminate and/or varying cross section in panel 1 where "columns" are recited.

Another advantage that arises from making the external circumference of each set of insert pairs 6,8 at least slightly smaller than the perimeter of each corresponding box 10 is that a solid side panel 16, extending from upper face 11 to lower face 12, will be formed between each set of adjacent corner edges 18. Solid side panels 16 will provide a solid perimeter 40 around each box 10. Solid side panels 16 will incorporate continuous columns 17 and will provide compression strength to panel 1 in the same manner as columns 17. Additionally, by arranging boxes 10 in panel 1 in rows 30 and columns 31 and by positioning boxes 10 so that each side panel 16 is shared with an adjacent box 10 (except at the edges of panel 1), the side panels 16 of each box 10 will align with and connect to the side panels 16 of the adjacent boxes 10 in each row and column. The result is a plurality of braces 21A and 21B running the length and width of panel 1. Braces 21A will be generally parallel to each other as will braces 21B, but braces 21A and 21B will be generally perpendicular to one another and will interlock at the intersections.

By positioning and sizing each set of insert pairs 6, 8 so that they do not touch at their inside surfaces facing one another, a central column of material 19 will be formed along the central axis 20 of each box 10. These central columns 19 will strengthen panel 1 against compressive forces in the same manner as columns 17.

By positioning and sizing each set of insert pairs 6, 8 so that they do not touch at all, a pair of cross panels 22 will be formed in each box 10. Cross panels 22 will extend from the interior surface of each corner edge 18 to the interior surface of the opposite corner edge 18 through and encompassing central column 19, where cross panels 22 will intersect and interlock. Cross panels 22 will preferably extend from upper face 11 to lower face 12 of box 10. Accordingly, cross panels 22 will further strengthen panel 1 against compressive forces in same manner as columns 19 and 17. However, by arranging boxes 10 in panel 1 so that each box 10 is cater-corner to another box 10 (i.e., such that certain boxes 10 will share a corner edge 18 and only a corner edge 18), cross panels 22 of one box 10 may be aligned and joined with cross panels 22 of cater-corner boxes 10, thereby forming a plurality of diagonal braces 23 extending across panel 1. As with braces 21A and 21B, diagonal braces 23 will consist of two sub-sets of braces 23A and 23B, each generally parallel to the other members of the sub-set but generally perpendicular to the members of the other sub-set. Diagonal braces 23 and braces 21A and 21B will intersect with one another at the corner edges 18 of each box, thereby creating a continuously reinforced latticework throughout panel 1. It will be noted that cross panels 22 are essentially vertical extensions of continuous bands 15, described above.

Each insert 5 will leave a corresponding void space 24 in boxes 10. Each void space 24 will have a base 25 opposite an apex 26, an interior 27, and a longitudinal axis 28 extending from base 25 to apex 26 and positioned substantially parallel to central axis 20 of each box 10. Inserts 5 will preferably be positioned and sized so that they do not extend the full depth of box 10. Accordingly, in the preferred embodiment, apexes 26 of void spaces 24 will be contained within box 10 between upper face 11 and lower face 12. Apexes 26 will preferably be concave with respect to interior 27, and void spaces 24 will preferably taper from base 25 to apex 26. This will provide an arched or domed effect to each void space 24, which will help to distribute loads directed parallel to longitudinal axis 28. Because inserts 5 are preferably triangular in cross-section, void spaces 24 will be triangular in cross-section as well. This will serve to inherently strengthen void spaces 24 and thus panel 1.

Although in the preferred embodiment, void spaces 24 have concave apexes and sides that angle inwardly, it would be possible to utilize inserts 5 that were essentially prism shaped, with straight walls and a flat end, to form void spaces 24. This would result in a loss of strength in-void spaces 24 as well as in the surrounding panel. However, the advantages gained from interconnecting diagonal braces 23 and braces 21A and 21B would still be present, as they are not dependent upon the shape of inserts 5 or void spaces 24.

By organizing inserts 5 into opposing pairs 6, 8, void spaces 24 may be positioned so that their respective longitudinal axes 28 alternate in orientation—that is, so that void spaces 24 are inverted with respect to each radially adjacent void space 24 within each box 10. This will help distribute compressive forces, perpendicular to upper and lower faces 11, 12, throughout each box 10 as well as panel 1. It will also create a solid section of material 29 in each upper face 11 and lower face 12 "over" each apex 26, where "up" is in reference to (and away from) each base 25. In upper face 11, a solid section 29 will preferably extend from two adjacent corners 14 to about midpoint 13U. A second solid section 29 will extend from the other two corners 14 of upper face 11 to about midpoint 1.3U. Both solid sections 29 in upper face 11 will preferably be generally triangular in shape and will together cover about half of upper face 11. Solid sections 29 will preferably meet at midpoint 13U and will together have the shape of an hourglass. Solid sections 29 will preferably have substantially the same shape and configuration in lower face 12 except that solid sections 29 in lower face 12 will be rotated approximately ninety degrees about central axis 20 with respect to solid sections 29 in upper face 11. It will be appreciated that in the preferred embodiment, solid sections 29 will generally be bounded on two sides by continuous bands 15 and that continuous bands 15 will be incorporated into solid sections 29. Solid sections 29 will serve to brace and reinforce each box 10 as well as panel 1.

As noted above, sets of pairs 6, 8 will preferably be organized in mold 2 in rows and columns. As a result, boxes 10 will be organized in rows 30 and columns 31, as well. By rotating each set of pairs 6, 8 of inserts 5 approximately ninety degrees with respect to each adjacent set of pairs 6, 8 of inserts 5, each box 10 will also be rotated approximately ninety degrees about its central axis 20 with respect to each adjacent box 10 sharing a row 30 or a column 31 with original box 10. Furthermore, it will also result in each adjacent box 10 not sharing a row 30 or a column 31 with original box 10 (i.e., each cater-corner box 10) being in rotational alignment with original box 10. This will facilitate the connection of continuous bands 15 and cross panels 22 from one box 10 to another, and thus the reinforcement of the entire panel 1.

In one embodiment, each void space 24 is less than half the length of each central axis 20. This will result in a central solid section of material, generally parallel to upper and lower faces 11, 12 extending through the middle of each box 10 and connecting to adjacent central solid sections of material in adjacent boxes 10 throughout panel 1, further strengthening panel 1.

It will be appreciated that in the preferred embodiment, each box 10 is interconnected with each adjacent box 10. Thus, when mold 2 is filled, all of the interstitial spaces between inserts 5 will be filled, and the resultant panel 1 will be one continuous piece.

It will be further appreciated that, in general, the strength of panel 1 will vary in inverse relationship to the overall size of void spaces 24. Thus, the strength of panel 1 may be generally increased by decreasing the size of inserts 5. Although the drawings of the preferred embodiments of panel 1 illustrate void spaces 24 as being uniform in size and relative spacing, that does not have to be the case. If greater strength is desired in certain sections of panel 1, inserts 5 may be diminished in size, moved closer together, or removed altogether in those sections.

Although the embodiments of panel 1 discussed above, may be curved, another preferred embodiment of panel 1 is particularly designed to facilitate fitting panel 1 to curved structures. In this embodiment, panel 1 will preferably be manufactured using vacuum molding although other molding techniques, such as injection molding, could be used if desired.

A vacuum mold 202 essentially comprises a body 101 having a plurality of cavities 102. In the present embodiment, the cavities would be sized and positioned to correspond to the desired void spaces 105 in panel 1. A sheet of thermoplastic material would be placed over body 101 and heated. When the thermoplastic material becomes pliable, a vacuum will be applied to the mold 202, which will pull the thermoplastic sheet into cavities 102. The resulting panel 1 will comprise a substantially flat surface 103 containing a plurality of apertures 104. Each aperture 104 will lead to a void space 105. The walls 106 of void spaces 105 will correspond to the walls 108 of cavities 102 in mold 202. The end 107 of void space 105 opposite aperture 104 will correspond to the bottom 107A of cavities 102. Ends 107 will generally be flat, though other shapes could be obtained simply by configuring cavities 102 as desired.

The size, shape, and location of cavities 102 in mold 202 will determine the characteristics of void spaces 105 in panel 1. In the preferred embodiment, cavities 102 will be generally triangular in cross section, though the corners of the triangles may be rounded in some embodiments. Apertures 204, leading to cavities 102, will be generally uniform in size in the preferred embodiment, though the size of apertures 104 could vary from aperture to aperture, if desired. Cavities 102 are preferably tapered in cross section, so that bottoms 107A are typically smaller in area than the corresponding aperture 204. Of course, where desired, bottoms 107A and corresponding apertures 204 may have the same area, shape and orientation. Walls 108 will preferably taper smoothly between apertures 104 and bottoms 107A.

Apertures 204 will preferably be positioned in mold 202 in pairs 109. Apertures 204 are preferably triangular in shape. Apertures 204 will preferably be positioned so that the apex of each triangle faces the corresponding apex of the other aperture 204 in the pair. Pairs 109 are preferably oriented within mold 202 in columns and rows, such that each pair 109, except those on an edge of mold 202, will be bordered by four other pairs 109. Pairs 109 are also preferably oriented so that every pair 109 is rotated ninety degrees with respect to any adjacent pair 109 but in rotational alignment with any cater-cornered pair 109.

A panel 1 formed in mold 202 described above will be comprised of a plurality of sections 110. Each section 110 will have an upper face 111. Each upper face 111 will have a midpoint 113U. Upper face 111 will preferably be generally rectangular and most preferably generally square in shape. Preferably, each upper face 111 will have four corners 114 and be about the same size and shape. Each upper face will also have a central axis 220 passing through midpoint 113U and being substantially perpendicular to upper face 111, although it will be appreciated that central axis 220 is a reference concept rather than a physical component of section 110.

By positioning apertures 102 as described above in mold 202, a continuous band of material 115 will extend from each corner 114 through midpoint 113U to the opposite corner 114. These continuous bands of material 115 will thus extend generally diagonally across each face 111 of each section 110, in a generally X-shaped pattern. Continuous bands of material 115 will strengthen each section 110. Moreover, sections 110 are positioned in panel 1 so that the corners 114 of one section 110 are adjacent to the corners 114 of three adjacent sections 110. At each corner intersection, each section 110 will share a side 116 with two radially adjacent sections 110 but will touch the other adjacent, but non-radially adjacent, section 110 only at a corner 114—i.e., the cater-corner section 110. Continuous bands of material 115 in one section 110 will join with continuous bands of material 115 in the non-radially adjacent (cater-corner) section 110. This will result in continuous bands of material 115 running diagonally across the upper face of the entire panel 1, rather than simply across each individual section 110. Thus, continuous bands of material 115 will form a plurality of diagonal interlocking braces 121C that reinforce the entire panel 1.

Unlike the preferred embodiment of panel 1 described above, the preferred embodiment of panel 1 described herein will not have side panels that extend around section 110 from upper face 111 to a lower face. However, each upper face 111 will preferably have a pair of solid panels 129 in and in substantially the same plane as upper face 111. Solid panels 129 will preferably be generally triangular in shape and will together cover about half of upper face 111. Solid panels 129 will preferably meet at midpoint 113U and will together have the shape of an hourglass. By arranging sections 110 in panel 1 in rows 130 and columns 131 and by positioning sections 110 so that the base edge (the edge opposite midpoint 113U) of each solid panel 129 comprises an edge 129A of both the section 110 to which the solid panel 129 belongs and an edge 129A of an adjacent section 110 (except at the edges of panel 1). As a result, four edges 129A comprised of solid material will extend between the adjacent corners 114 of each section 110, forming a solid perimeter around each section 110. Furthermore, the edges 129A of each section 110 will align with and connect to the edges 129A of the adjacent sections 110 in each row and column. The result is a plurality of braces 121A and 121B running across the upper face of the entire panel 1. Braces 121A will be generally parallel to each other as will braces 121B, but braces 121A and 121B will be generally perpendicular to one another and will interlock at the intersections.

As noted above, the preferred embodiment of panel 1 described herein comprises a plurality of void spaces 105 having an aperture 104, an end 107 and walls 106 extending from aperture 104 to end 107. Void spaces 105 will preferably be triangular in cross section, though the corners may be rounded to dissipate forces that may be applied at the corners. Walls 106 will generally be tapered so that the area of end 107 is different from the area of aperture 104. This difference in area between apertures 104 and ends 107 will result in a substantial amount of space or gaps between ends 107, the amount of which will depend on the degree of taper of walls 106. These gaps allow the upper face of panel 1 to be flexed without walls 106 and ends 107 of the adjacent void spaces 105 hitting one another.

The gaps between ends 107 may be uniform if desired. This will allow this embodiment of panel 1 to be easily conformed to a wide variety of curved surfaces. However, the shape and contour of many objects with which panel 1 is to be used will be known in advance. In such instances it will be possible to design the taper of each individual wall 106 so that each bottom 107 will be substantially parallel to the surface of the object at the point where the particular bottom 107 and the surface meet. Additionally, the taper of each wall 106 can be selected to insure that a plurality of walls 106, or preferably all of walls 106, are normal to both the upper surface of panel 1 and to the surface of the object to which panel 1 is to be attached at the point where wall 106 and the surface meet, when panel 1 is distorted into its desired shape.

For example, this embodiment of panel 1 might be used to provide internal support to a snow ski. In its undeformed state, none of the walls 106 would be normal to the upper surface of the panel or to the curved portion of the ski. However, by properly selecting the taper of each wall 106, curving panel 1 to fit the curved portion of the ski will align walls 106 in a position that is normal to both the upper surface of the panel and the surface of the ski. Where the panel should contact both the upper and the lower surface of the ski, walls 106 will be normal to the upper and lower surfaces of the ski through the curved portion of the ski. By designing the walls of panel 1 to be normal to both the upper and lower surfaces of the ski, panel 1 will provide substantial compression strength to panel 1 and to the ski.

In the ski example, the walls 106 of the void spaces 105 of panel 1 could be provided with little or no taper in the flat portions of the ski with the tapering beginning at a point in panel 1 that would allow those portions of panel 1 designed to fit within the curved section of the ski to both easily conform to the curved space and to position walls 106 normal to both the upper and lower surfaces of the ski. When panel 1 is designed for use with objects exhibiting more complex curvature, the taper of each wall 106 may be individually designed to match.

It will be appreciated that the upper surface of this embodiment of panel 1 is provided with braces 121A, 121B, and 121C. However, these braces are not present in the lower surface of this embodiment of panel 1. This can be overcome by laminating the lower surface of panel 1 with a sheet 51 of plastic or other material. Ideally, sheet 51 would be formed to fit the curvature of the surface where panel 1 is intended. Panel 1 would be deformed to fit the curvature of sheet 51 and then laminated to sheet 51. The combination of sheet 51 and panel 1 could then be installed in the object to be strengthened by panel 1.

Both embodiments of panel 1 may be used to construct any structure where high strength and low density is important, either because of weight concerns or for reasons of economy. Examples include skis; surfboards; shelving; construction panels for buildings, aircraft, spacecraft, automobiles, boats, and etc. If desirable in the particular application, specific or general purpose fillers 50 may be added to some or all of void spaces 24, 105 in panel 1. Examples of filler material include sound dampening material such as polyether urethane or fire retardant materials such as asbestos, phenolic based foams, and gypsum sand. A laminated surface 51 may be applied over the upper and/or lower face of panel 1 for aesthetic, structural, aerodynamic, hydrodynamic, or other reasons, as desired.

Although the invention has been described in terms of its preferred embodiment, other embodiments will be apparent to those of skill in the art from a review of the foregoing. Those embodiments as well as the preferred embodiments are intended to be encompassed by the scope and spirit of the following claims.

I claim:

1. A high strength low density panel comprising:

a plurality of sections, each said section having an upper face having a midpoint and a central axis substantially perpendicular to said upper face, said upper face having four corners, said upper face further comprising a continuous band of material extending from each corner of said upper face to an opposite corner of said upper face through a point proximate to said midpoint;

each section having four edges of continuous material, each edge extending from each corner to an adjacent corner;

each section further comprising a plurality of void spaces, each said void space depending from an aperture in said upper face and having an end opposite said aperture and walls extending therebetween.

2. The high strength low density panel according to claim 1 wherein said sections are positioned in said panel in rows and columns.

3. The high strength low density panel according to claim 2 wherein said walls are tapered to create gaps between said ends of said void spaces, whereby said gaps will allow said void spaces to move without interfering with each other when said panel is flexed.

4. The high strength low density panel according to claim 3 further comprising a curved surface having a contour positioned adjacent to said upper face wherein said panel is configured to be flexed to match the contour of said curved surface.

5. The high strength low density panel according to claim 4 wherein a plurality of said walls are angled relative to said upper face to position said plurality of said walls substantially normal to said curved surface when said panel is flexed to match the contour of said adjacent curved surface.

6. The high strength low density panel according to claim 2 wherein said void spaces are connected to each other only via said upper face.

7. The high strength low density panel according to claim 2 wherein said sections are positioned within said panel relative to each other so that the continuous bands of material extending between opposite corners of one section join with the continuous bands of material extending between opposite corners of each cater-corner section, whereby an interlocking plurality of diagonal braces is created across said panel.

8. The high strength low density panel according to claim 2 wherein said upper face further comprises at least one solid section of material extending from two of said corners of said upper face to about said midpoint of said upper face.

9. The high strength low density panel according to claim 2 wherein said sections are oriented with respect to each other within said panel so that each section is rotated about ninety degrees about its central axis with respect to each adjacent section.

10. The high strength low density panel according to claim 1 wherein said void spaces are filled with sound dampening material.

11. The high strength low density panel according to claim 1 wherein said void spaces are filled with flame retardant material.

12. The high strength low density panel according to claim 1 further comprising a laminated surface covering said upper faces of said sections.

13. The high strength low density panel according to claim 1 further comprising a laminated surface covering said ends of said sections.

14. The high strength low density panel according to claim 2 wherein said sections are positioned within said panel relative to each other so that the edges of one section join with the edges of each adjacent section, whereby an interlocking plurality of substantially perpendicular braces is created across said panel.

15. The high strength low density panel according to claim 14 wherein said sections are positioned within said panel relative to each other so that the continuous bands of material extending between opposite corners of one section join with the continuous bands of material extending between opposite corners of each cater-corner section, whereby an interlocking plurality of diagonal braces is created across said panel.

16. The high strength low density panel according to claim 15 wherein said ends of said void spaces are substantially flat.

17. The high strength low density panel according to claim 15 wherein said void spaces are substantially triangular in cross section.

18. The high strength low density panel according to claim 15 wherein said panel is substantially flexible.

19. The high strength low density panel according to claim 7 wherein said walls are tapered to create gaps between said ends of said void spaces, whereby said gaps will allow said void spaces to move without interfering with each other when said panel is flexed.

20. The high strength low density panel according to claim 19 further comprising a curved surface having a contour positioned adjacent to said upper face wherein said panel is configured to be flexed to match the contour of said curved surface.

21. The high strength low density panel according to claim 20 wherein a plurality of said walls are angled relative to said upper face to position said plurality of said walls substantially normal to said curved surface when said panel is flexed to match the contour of said adjacent curved surface.

22. The high strength low density panel according to claim 15 wherein said void spaces are connected to each other only via said upper face.

23. The high strength low density panel according to claim 22 wherein said panel is substantially flexible.

* * * * *